US006921179B2

(12) United States Patent
Diak Ghanem

(10) Patent No.: US 6,921,179 B2
(45) Date of Patent: Jul. 26, 2005

(54) INSULATED AND LUMINESCENT DRINKING VESSEL

(75) Inventor: Darlene Diak Ghanem, Deerfield Beach, FL (US)

(73) Assignee: Worry Free Inventions, Inc., Deerfield Beach, FL (US)

( * ) Notice: Subject to any disclaimer, the term of this patent is extended or adjusted under 35 U.S.C. 154(b) by 148 days.

(21) Appl. No.: 10/304,196

(22) Filed: Nov. 25, 2002

(65) Prior Publication Data

US 2003/0076673 A1 Apr. 24, 2003

Related U.S. Application Data

(63) Continuation-in-part of application No. 10/000,826, filed on Oct. 24, 2001.

(51) Int. Cl.[7] ..... F21V 9/16

(52) U.S. Cl. ..... 362/84; 362/101; 206/217; 220/592.17; 250/462.1

(58) Field of Search ..... 362/84, 101, 234, 362/253; 40/324, 542; 206/217, 457; 220/592.16, 592.17; 250/462.1, 465.1, 466.1

(56) References Cited

U.S. PATENT DOCUMENTS 2,577,030 A * 12/1951 Neumann ..... 40/542
6,213,616 B1 * 4/2001 Chien ..... 362/84
6,619,811 B2 * 9/2003 Wang et al. ..... 362/101

* cited by examiner

*Primary Examiner*—Stephen F Husar
(74) *Attorney, Agent, or Firm*—Robert M. Downey, PA

(57) ABSTRACT

A drinking vessel is provided with an insulated wall structure including an inner wall, an outer wall, and a void between the inner and outer walls providing an insulative barrier for maintaining the temperature of the liquid contents within a desired range for extended periods of time, while also preventing the formation of condensation on the outside of the vessel. Luminescent elements, such as shapes, letters, numbers or designs, are applied to the insulated wall structure to enhance visibility of the drinking vessel and the level of liquid beverage contents when in dark or low light conditions. In an alternative embodiment, the luminescent material is incorporated into the composition of the wall structure during the molding process. A removable lid may be provided for covering the open top of the drinking vessel. In one embodiment, the drinking vessel and removable top lid are structured and disposed to provide a child's sip cup, wherein the lid includes an integrated sip spout and valve for resisting spills.

8 Claims, 4 Drawing Sheets

INSULATED AND LUMINESCENT DRINKING VESSEL

This application is a continuation-in-part of co-pending patent application Ser. No. 10/000,826 filed on Oct. 24, 2001.

BACKGROUND OF THE INVENTION

1. Field of the Invention

This invention relates to insulated drinking vessels and, more particularly, to drinking vessels including tall glasses, cups, mugs and child's sip cups, all having an inner wall and an outer wall spaced from the inner wall to provide an insulating wall structure. In at least one embodiment, a luminescent material is applied to the insulating wall structure to enhance visibility of the drinking vessel and the level of liquid contents contained therein when in dark and dim light environments.

2. Discussion of the Related Art

Insulated cups and containers of various size and shape are well known in the art. Moreover, the use of a double-wall construction to provide insulative qualities to a drinking cup is known. Typically, insulated cups of double-wall construction are made of a polycarbonate or other plastic composition and include an inner wall, an outer wall and a void between the walls. Usually, the inner and outer walls are joined at or near a top rim and, in some cases, the walls are transparent.

Despite the known developments in the art relating to insulated drinking cups of double-wall construction, there remains a need for an insulated drinking vessel, for both adults and children, which incorporates both a double-wall insulative construction and luminescent means for enhancing the visibility of the drinking vessel and the level of liquid contents therein when in dark and dim light conditions. Moreover, there remains a need for a double-wall insulated drinking vessel which includes a removable top lid with an integrated sip spout. More particularly, there remains a need for a child's sip cup having a double-wall insulative construction and a removable screw-on lid having an integrated sip spout and valve on the lid.

OBJECTS AND ADVANTAGES OF THE INVENTION

With the foregoing in mind, it is a primary object of the present invention to provide a drinking vessel which is both insulated and luminescent, to thereby maintain liquid contents contained therein within a desired temperature range for longer periods of time while also enhancing the visibility of the drinking vessel and the level of the liquid contents therein when in a dim light or dark environment.

It is a further object of the present invention to provide an insulated and luminescent drinking vessel which incorporates a double-wall structure including an inner wall, an outer wall and an air space between the walls.

It is still a further object of the present invention to provide a drinking vessel which includes an insulated double-wall structure, including an inner wall and an outer wall, and further wherein the wall structure of the drinking vessel is provided with luminescent means for enhancing visibility of the drinking vessel and the amount of liquid contents therein when in dark or low light conditions.

It is still a further object of the present invention to provide a drinking vessel which is insulated and luminescent, and further wherein the drinking vessel is provided in various sizes, styles and shapes for both adults and children.

It is yet a further object of the present invention to provide an insulated and luminescent drinking vessel which includes a removable top lid with an integral sip spout.

It is yet a further object of the present invention to provide an insulated child's sip cup, having an inner wall, an outer wall, and an insulative void therebetween, and further wherein the sip cup includes a removable lid with an integral sip spout and valve.

These and other objects and advantages of the present invention are more readily apparent with reference to the detailed description and drawings.

SUMMARY OF THE INVENTION

The present invention is directed to a drinking vessel provided with an insulated wall structure including an inner wall, an outer wall, and a void between the inner and outer walls for maintaining the temperature of the liquid contents within a desired range for extended periods of time, while also preventing the formation of condensation on the outside of the vessel. Luminescent elements, such as shapes, letters, numbers or designs, are applied to the insulated wall structure to enhance visibility of the drinking vessel and the level of liquid beverage contents when in dark or low light conditions. In an alternative embodiment, the luminescent material is incorporated into the composition of the wall structure during the molding process. A removable lid may be provided for covering the open top of the drinking vessel. In one embodiment, the drinking vessel and removable top lid are structured and disposed to provide a child's sip cup, wherein the lid includes an integrated sip spout and valve for resisting spills.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENTS

Figure 1:
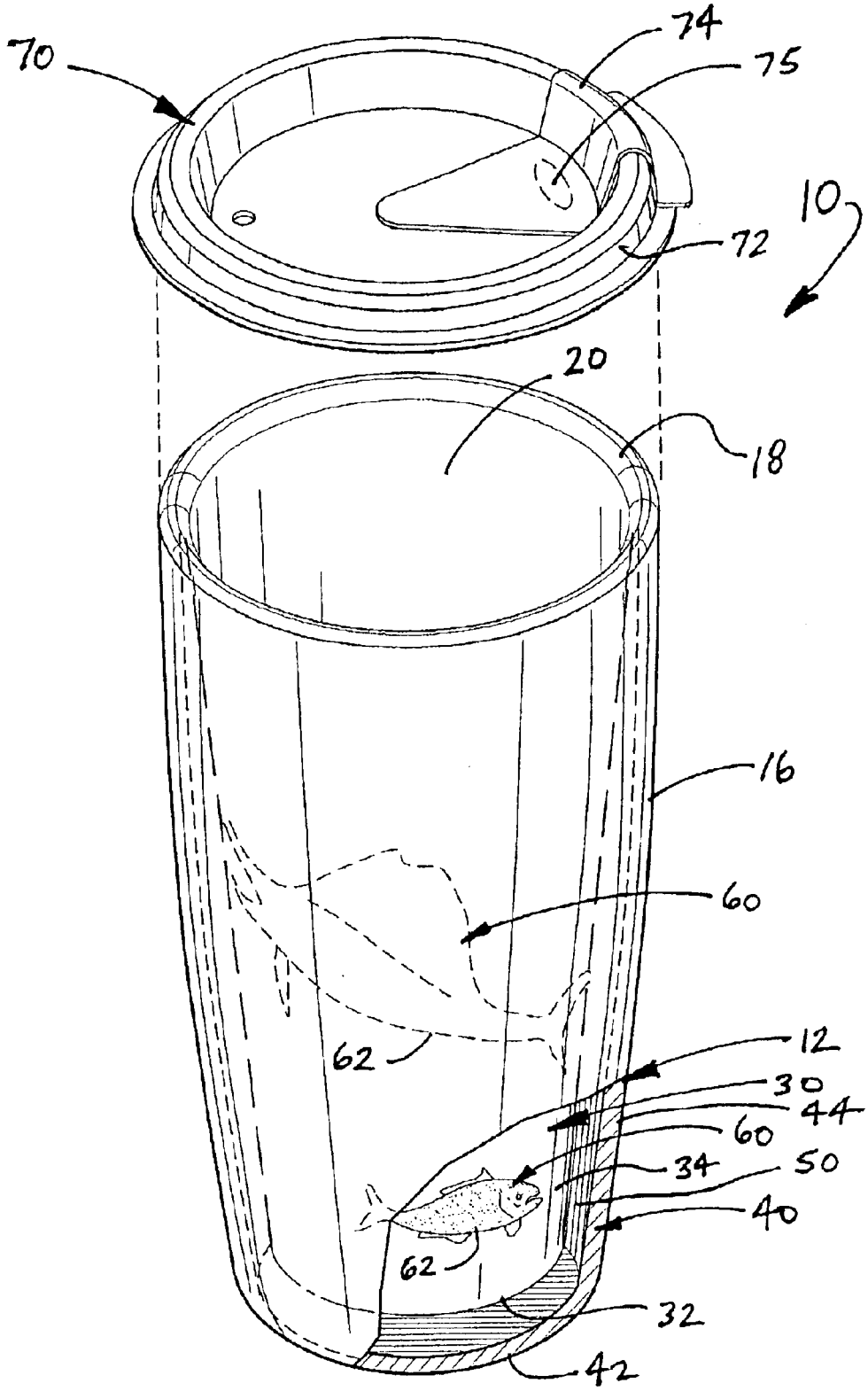
FIG. 1 is a top exploded perspective view, in partial cutaway, illustrating an insulated and luminescent drinking vessel with a removable top lid, in accordance with one preferred embodiment of the present invention.
Figure 2:
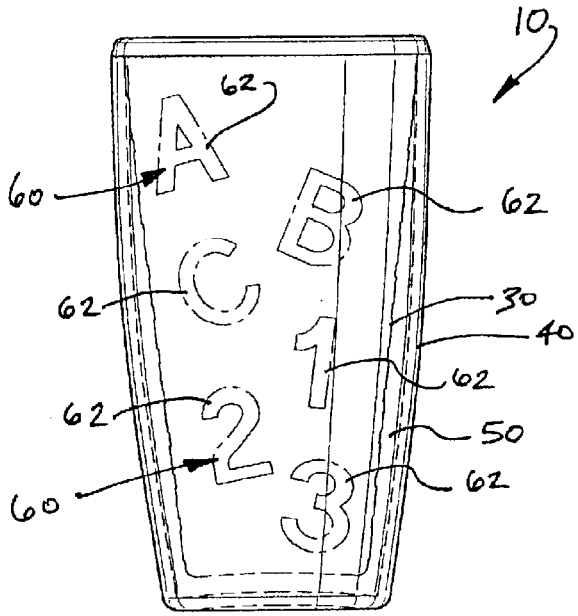
FIG. 2 is a side elevational view of the insulated and luminescent drinking vessel, wherein the drinking vessel is in the form of a tumbler or tall glass.
Figure 3:
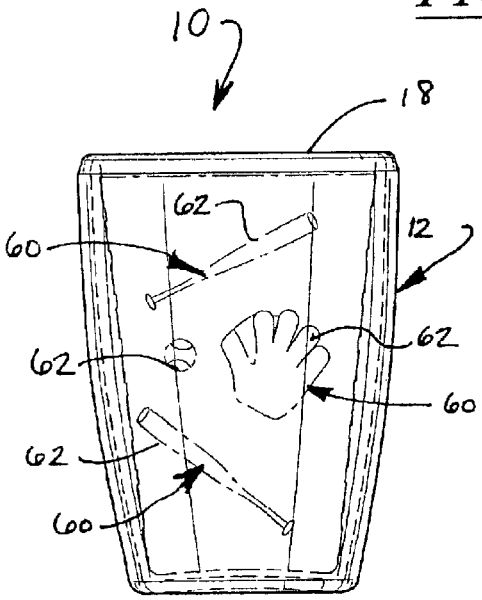
FIG. 3 is a side elevational view of the insulated and luminescent drinking vessel, wherein the drinking vessel is in the form of a drinking cup.

Referring to the several views of the drawings, the insulated drinking vessel of the present invention is shown in accordance with various embodiments thereof and is generally indicated as 10 throughout the drawings.

In each embodiment, the drinking vessel 10 is defined primarily by an insulated wall structure 12 forming a bottom 14 and side wall configuration 16 extending from the bottom and terminating at a top rim 18. The top rim 18 surrounds an open top 20 of the drinking vessel which communicates with an interior chamber 22 for holding hot or cold beverage contents therein.

The insulated wall structure 12 includes a inner wall 30 having a bottom 32 and a surrounding sidewall structure 34 extending from the bottom 32 to the top rim and surrounding the interior chamber 22. The insulated wall structure 12 further includes an outer wall 40 having a bottom 42 and sidewall structure 44 extending from the bottom 42 to the top rim. As seen in the several views of the drawings, the outer wall 40 is spaced from the inner wall 30 to create a void 50 between the sidewalls 34 and 44, respectively, as well as the bottoms 32, 42, respectively. In a preferred embodiment, the inner wall 30 is joined with the outer wall 40 at or near the top rim. The joining of the inner and outer walls can be accomplished by various means well known in the art. For example, joining of the inner wall 32 and the outer wall 40 at or near the top rim can be achieved by a heat seal, or suitable adhesive.

In each of the embodiments, the double-wall construction of the insulated wall structure is adapted for maintaining the liquid contents in the interior chamber either warm or cold for extended periods of time. More specifically, the insulated wall structure serves to maintain the temperature of the liquid contents within a desired temperature range for a period of time which is significantly longer as compared to conventional drinking vessels having no insulative qualities. The double-wall construction with the insulative barrier (i.e. void) serves to insulate the liquid contents from the exterior ambient air temperature, thereby slowing the rate of heat transfer between the liquid contents and the outside air temperature surrounding the drinking vessel. Further, the barrier created by the void between the inner and outer walls prevents the formation of condensation on the exterior surfaces of both the inner wall 30 and the outer wall 40.

As shown in FIGS. 1-8, the insulated wall structure 12 of the drinking vessel 10 is provided with luminescent means 60 for illuminating the drinking vessel 10 in a dark or dim light atmosphere. In a preferred embodiment, the luminescent means 60 is structured to hold a charge of light which is released over a period of time, preferably up to eight hours after full charging. The illuminating character of the luminescent means 60, often referred to as glow-in-the-dark, provides a novel and ornamental appearance which is attractive and amusing to both adults and children. Further, the illuminating characteristics of the luminescent means 60 serves to enhance the visibility of the drinking vessel 10, as well as the level of the liquid contents contained therein, when in low light or dark conditions. In several embodiments, the luminescent means 60 is provided in the form of decorative elements 62, such as attractive shapes, letters, numbers, objects and animated characters. In this instance, the decorative elements 62 may be formed of a luminescent material, such as a vinyl material, which is applied to the surface of either the inner wall 30 or outer wall 40. Preferably, the luminescent decorative elements 62 are applied to either the outside surface of the inner wall 30 or the inside surface of the outer wall 40, so that the luminescent decorative elements 62 are protectively maintained within the sealed void formed between the inner and outer walls.

In an alternative embodiment, the luminescent means 60 is incorporated into the composition of the insulated wall structure 12 of the drinking vessel 10, such as in a powder form which is mixed with the wall material composition during the molding process. In this embodiment, the luminescent material composition may be incorporated within the inner wall 30 and/or the outer wall 40. Moreover, the luminescent material may be incorporated within portions of the inner wall or outer wall, or throughout the entire composition of either or both the inner wall or outer wall.

As seen in FIGS. 1–3 and 5–8, the outer wall may be formed of a transparent material so that the luminescent decorative elements 62 are visible through the outer wall. In a preferred embodiment, both the outer wall 40 and the inner wall 30 are formed of a plastic composition, such as a poly carbon material. In at least one embodiment, both the outer wall 40 and the inner wall 30 are transparent, so that the luminescent decorative elements 62 and the liquid contents are easily visible through the wall structure from an exterior of the drinking vessel. It is noted, however, that the inner wall 30 and/or the outer wall 40 may be partially or fully formed of a translucent or opaque material which may incorporate the luminescent means.

Figure 4:
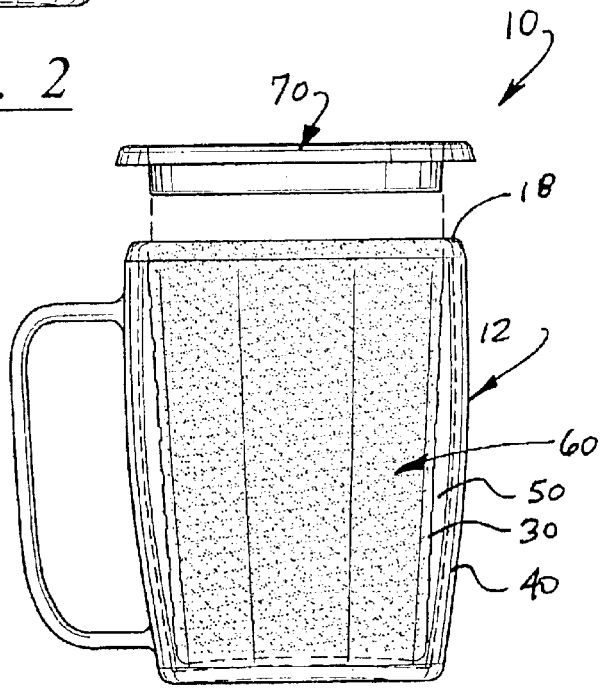
FIG. 4 is an exploded side elevational view of an insulated and luminescent drinking vessel, wherein the drinking vessel is in the form of a beverage mug with a handle and a luminescent material is incorporated into the entire composition of the inner or outer wall structure of the drinking vessel, in accordance with an alternative embodiment of the present invention.
Figure 5:
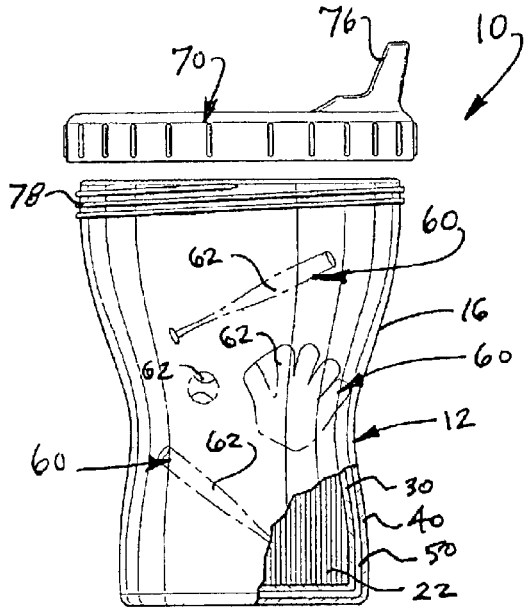
FIG. 5 is a side elevational view of the insulated and luminescent drinking vessel of the present invention, shown in partial cutaway, and wherein the drinking vessel is in the form of a child's sip cup with an hourglass configuration for easy grasping by infants and toddlers.
Figure 6:
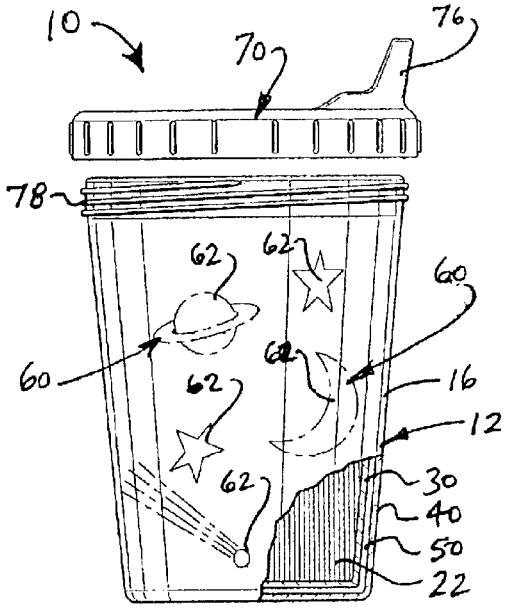
FIG. 6 is a side elevational view of the insulated and luminescent drinking vessel, shown in partial cutaway, illustrating another embodiment of a child's sip cup.
Figure 7:
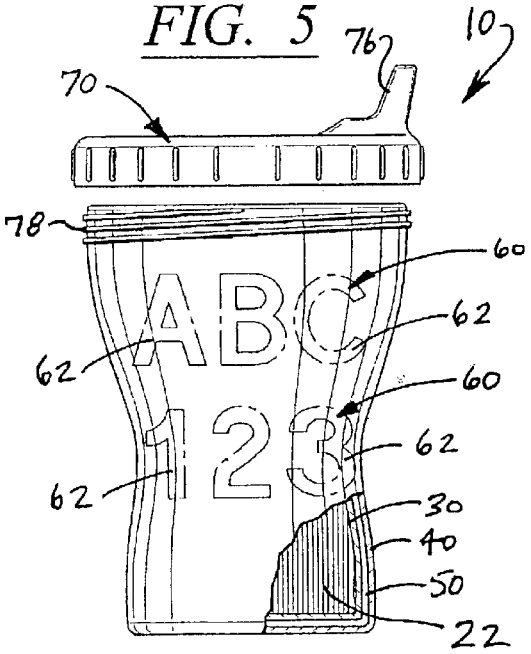
FIG. 7 is a side elevational view of the insulated and luminescent drinking vessel, shown in partial cutaway, illustrating yet a further embodiment of a child's sip cup.
Figure 8:
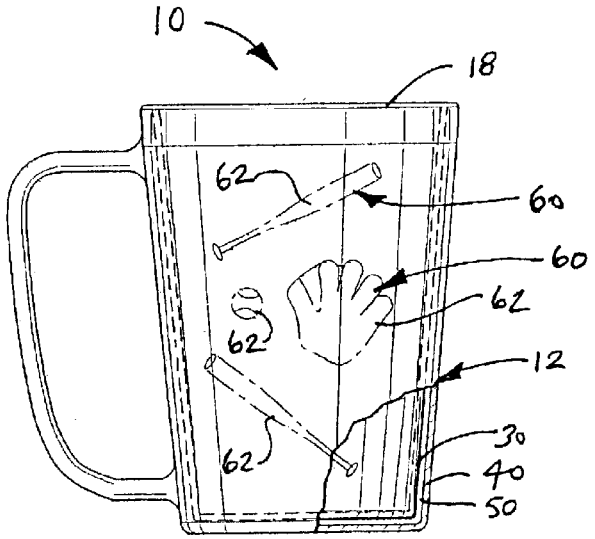
FIG. 8 is a side elevational view, in partial cutaway, illustrating an insulated and luminescent drinking vessel, wherein the drinking vessel is in the form of a mug with a handle.
Figure 9:
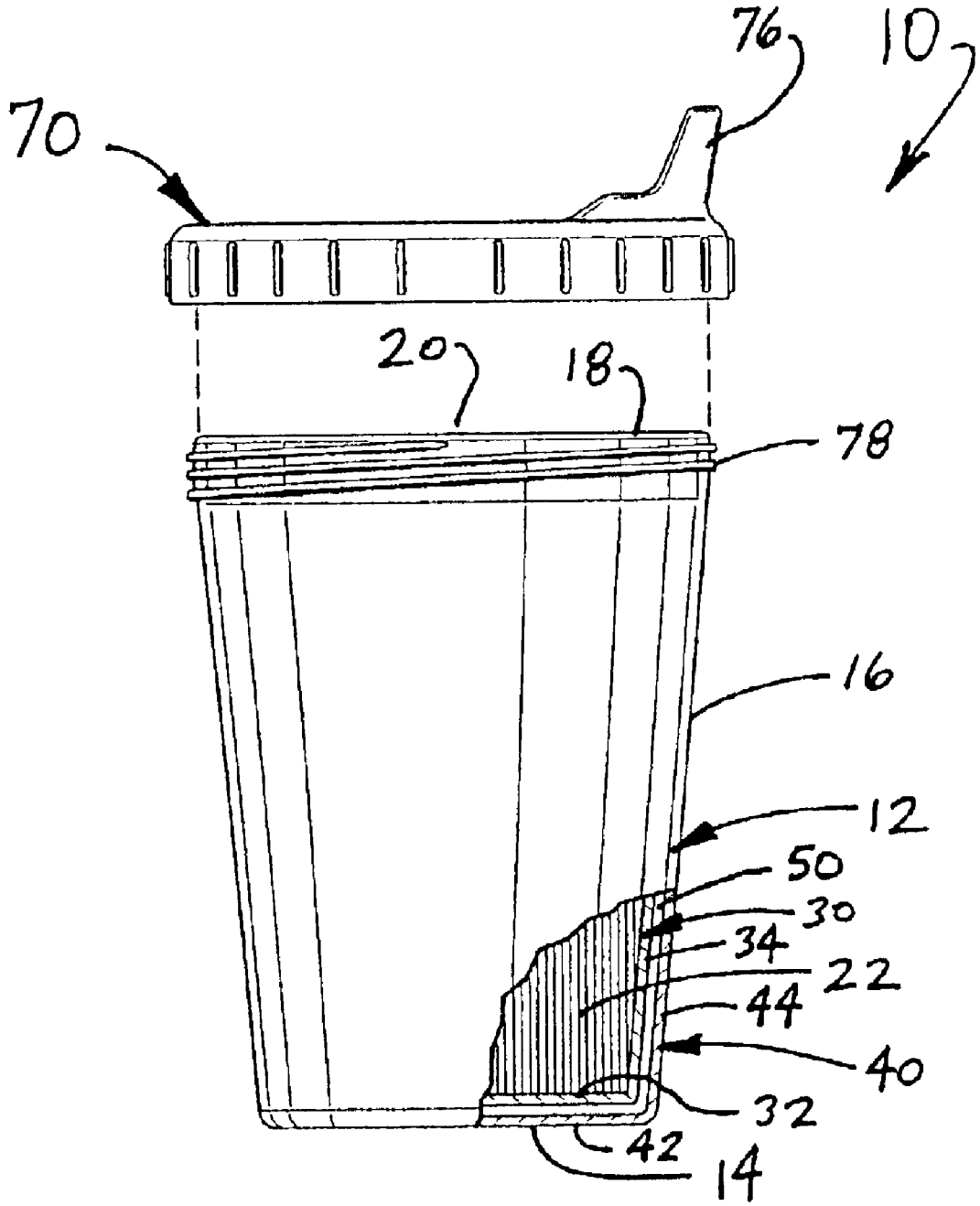
FIG. 9 is an exploded side elevational view, in partial cutaway, illustrating yet another embodiment of the present invention in the form of an insulated child's sip cup with a removable lid.

As seen in FIGS. 1, 4 and 5–9, the various embodiments of the drinking vessel 10 may be further provided with a removable top lid 70. In the embodiments of FIGS. 1 and 4, the removable top lid 70 is attached to the top rim 18 of the drinking vessel by friction resulting from the snug fit between the top rim 28 and an engaging lip 72 or channel formed on the lid. In this embodiment, the top lid is structured and styled for use by older children and adults and may include a moving cover or flap 74 to protectively cover an opening 75 in the lid. When it is desired to drink from the vessel 10, the protective cover can be removed to reveal the opening, thereby allowing the user to drink from the vessel with the lid attached.

In other embodiments of the invention, the drinking vessel is formed and configured as a child's sip cup, as seen in FIGS. 5–7 and 9. In these various embodiments, the top lid is removably attached to the drinking vessel 10 by cooperating screw threads 78 formed about the outer top surface of the drinking vessel, near the rim, and within the inner circumferential surface of the lid. As seen in the drawing figures, the top lid for the child's sip cup includes an integral sip spout 76. A valve may further be provided on the underside of the lid to block the passage of the liquid contents through the sip spout when a child is not drinking from the sip cup, thereby preventing accidental spills.

While the instant invention has been shown and described in accordance with preferred and practical embodiments thereof, it is recognized that departures from the instant disclosure are contemplated within the spirit and scope of the present invention which, therefore, should not be limited except as set forth in the following claims as interpreted under the doctrine of equivalents.

What is claimed is:

1. A drinking vessel for containing a liquid beverage to be consumed therefrom, said drinking vessel comprising:

an insulated wall structure forming a bottom and side walls and terminating at a top rim surrounding an open top of said drinking vessel;

said insulated wall structure comprising:

an inner wall;

an outer wall spaced from said inner wall to provide a void between said inner wall and outer walls, and said void surrounding said inner wall; and said inner and outer walls being joined at said top rim; and phosphorescence means on said insulated wall structure for illuminating the drinking vessel in dark and dim light conditions.

2. The drinking vessel as recited in claim 1 wherein said phosphorescence means comprises at least one decorative element formed of a phosphorescent material.

3. The drinking vessel, as recited in claim 2 wherein said at least one phosphorescent decorative element is applied to said inner wall.

4. The drinking vessel as recited in claim 2 wherein said at least one phosphorescent decorative element is applied to said outer wall.

5. A drinking vessel for containing a liquid beverage to be consumed therefrom, said drinking vessel comprising:

a top rim surrounding an open top;

an insulated wall structure comprising:

an inner wall;

an outer wall spaced from said inner wall with a void between said inner and outer walls; and phosphorescence means on said insulated wall structure for illuminating the drinking vessel in dark and dim light conditions.

6. The drinking vessel as recited in claim 5 wherein said phosphorescence means comprises at least one decorative element formed of a phosphorescent material.

7. The drinking vessel as recited in claim 6 wherein said at least one phosphorescent decorative element is applied to said inner wall.

8. The drinking vessel as recited in claim 6 wherein said at least one phosphorescent decorative element is applied to said outer wall.

* * * * *